US008535777B2

(12) United States Patent
Marissen et al.

(10) Patent No.: US 8,535,777 B2
(45) Date of Patent: Sep. 17, 2013

(54) MULTILAYERED MATERIAL SHEET AND PROCESS FOR ITS PREPARATION

(75) Inventors: Roelof Marissen, Born (NL); Joseph Arnold Paul Maria Simmelink, Sittard (NL); Reinard Jozef Maria Steeman, Elsloo (NL); Gijsbertus Hendrikus Maria Calis, Hulsberg (NL); Jacobus Johannes Mencke, Maastricht (NL); Jean Hubert Marie Beugels, Landgraaf (NL); David Vanek, Charlotte, NC (US); Johann Van Elburg, Landgraaf (NL); Alexander Volker Peters, Aachen (DE); Steen Tanderup, Maastricht (NL)

(73) Assignee: DSM IP Assets B.V., Heerlen (NL)

( * ) Notice: Subject to any disclaimer, the term of this patent is extended or adjusted under 35 U.S.C. 154(b) by 592 days.

(21) Appl. No.: 12/298,630

(22) PCT Filed: Apr. 26, 2007

(86) PCT No.: PCT/EP2007/003690

§ 371 (c)(1),
(2), (4) Date: May 11, 2009

(87) PCT Pub. No.: WO2007/122011

PCT Pub. Date: Nov. 1, 2007

(65) Prior Publication Data

US 2010/0068962 A1 Mar. 18, 2010

Related U.S. Application Data

(60) Provisional application No. 60/876,544, filed on Dec. 22, 2006.

(30) Foreign Application Priority Data

| | | |
|---|---|---|
| Apr. 26, 2006 | (EP) | 06008600 |
| Jun. 29, 2006 | (EP) | 06013452 |
| Dec. 22, 2006 | (EP) | 06026725 |

(51) Int. Cl.

| | |
|---|---|
| ***B32B 5/12*** | (2006.01) |
| ***B32B 5/26*** | (2006.01) |
| ***B32B 37/12*** | (2006.01) |
| ***B32B 38/00*** | (2006.01) |

(52) U.S. Cl.
USPC ..... 428/105; 139/383 R; 428/107; 428/156; 428/213; 428/364; 429/144

(58) Field of Classification Search
USPC ..... 428/156, 107, 213, 364, 105; 139/383, 139/383 R; 429/144
See application file for complete search history.

(56) References Cited

U.S. PATENT DOCUMENTS

| | | | | |
|---|---|---|---|---|
| 4,413,110 | A | 11/1983 | Kavesh et al. | |
| 4,931,126 | A * | 6/1990 | McCarville et al. | 156/304.6 |
| 5,032,338 | A | 7/1991 | Weedon et al. | |
| 5,736,244 | A | 4/1998 | Kavesh et al. | |
| 6,448,359 | B1 * | 9/2002 | Kavesh | 526/352 |
| 2002/0124900 | A1 * | 9/2002 | Khokar | 139/11 |
| 2005/0089677 | A1 * | 4/2005 | Marissen et al. | 428/299.1 |
| 2006/0252325 | A1 | 11/2006 | Matsumura et al. | |

FOREIGN PATENT DOCUMENTS

| | | | |
|---|---|---|---|
| EP | 0 187 974 | | 7/1986 |
| EP | 0 187 974 | B1 | 7/1986 |
| EP | 1 627 719 | | 2/2006 |
| EP | 1 627 719 | A1 | 2/2006 |
| JP | 64-38439 | | 3/1989 |
| JP | 8-47994 | | 2/1996 |
| JP | 2004-292992 | | 10/2004 |
| WO | 88-03184 | | 5/1988 |
| WO | 00/48821 | | 8/2000 |
| WO | 00/48821 | A1 | 8/2000 |
| WO | 01/73173 | | 10/2001 |
| WO | 01/73173 | A1 | 10/2001 |
| WO | 2005/066400 | | 7/2005 |
| WO | 2005/066400 | A1 | 7/2005 |
| WO | 2005/066401 | | 7/2005 |
| WO | 2005/066401 | A1 | 7/2005 |
| WO | 2006-002977 | | 1/2006 |
| WO | 2006/073743 | | 7/2006 |
| WO | 2006/073743 | A1 | 7/2006 |
| WO | 2007/003334 | | 1/2007 |
| WO | 2007/003334 | A1 | 1/2007 |

OTHER PUBLICATIONS

International Search Report for PCT/EP2007/003690, mailed Dec. 27, 2007.

* cited by examiner

*Primary Examiner* — Brent O'Hern
(74) *Attorney, Agent, or Firm* — Nixon & Vanderhye P.C.

(57) ABSTRACT

The invention relates to a multilayered material sheet comprising a consolidated stack of unidirectional monolayers of drawn ultra high molecular weight polyolefine. The draw direction of two subsequent monolayers in the stack differs. Moreover the thickness of at least one monolayer does not exceed 50 μm, and the strength of at least one monolayer is comprised between 1.2 GPa and 3 GPa. The invention also relates to a ballistic resistant article comprising the multilayered material sheet and to a process for the preparation of the ballistic resistant article.

21 Claims, No Drawings

MULTILAYERED MATERIAL SHEET AND PROCESS FOR ITS PREPARATION

This application is the U.S. national phase of International Application No. PCT/EP2007/003690, filed 26 Apr. 2007, which designated the U.S. and claims priority to Europe Application No(s). 06008600.6 filed 26 Apr. 2006, 06013452.5 filed 29 Jun. 2006, 06026725.9 filed 22 Dec. 2006 and U.S. 60/876,544 filed 22 Dec. 2006, the entire contents of each of which are hereby incorporated by reference.

The invention relates to a multilayered material sheet comprising a consolidated stack of unidirectional monolayers of drawn ultra high molecular weight polyolefine, and to a process for its preparation. The invention also relates to a ballistic resistant article comprising the multilayered material sheet.

A multilayered material sheet comprising a consolidated stack of unidirectional monolayers of drawn ultra high molecular weight polyethylene is known from EP 1627719 A1. This publication discloses a multilayered material sheet comprising a plurality of unidirectional monolayers consisting essentially of ultra high molecular weight polyethylene and essentially devoid of bonding matrices, whereby the draw direction of two subsequent monolayers in the stack differs. The disclosed thickness for the monolayers of the multilayered material sheet is between 30-120 μm, with a preferred range of 50-100 μm.

The multilayered material sheet according to EP 1627719 A1 uses ultra high molecular weight polyethylene, essentially devoid of bonding matrices. This feature is necessary in order to obtain the desired antiballistic properties. Although the multilayered material sheet according to EP 1627719 A1 shows a satisfactory ballistic performance, this performance can be improved further.

The object of the present invention is to provide a multilayered material sheet having improved antiballistic properties when compared to the known material.

This object is achieved according to the invention by providing a multilayered material sheet comprising a consolidated stack of unidirectional monolayers of drawn ultra high molecular weight polyolefine, whereby the draw direction of two subsequent monolayers in the stack differs, whereby the thickness of at least one monolayer does not exceed 50 μm, and whereby the strength of at least one monolayer is at least 1.2 GPa, 2.5 GPa or 3.0 GPa. Preferably the strength of at least one monolayer is comprised between 1.2 GPa and 3 GPa, more preferably between 1.5 and 2.6 GPa, and most preferably between 1.8 and 2.4 GPa. It has been surprisingly found that this particular combination of features yields an improved antiballistic performance over the known multilayered material sheet. More in particular, when the antiballistic performance of the multilayered material sheet according to EP 1627719 A1 is scaled at 100%, antiballistic performance of more than 130% has been obtained with the multilayered material sheet according to the invention. An additional advantage of the material sheet according to the invention is that it is no longer required to use ultra high molecular weight polyethylene essentially devoid of bonding matrices in order to obtain the desired level of antiballistic properties.

A preferred multilayered material sheet according to the invention is characterized in that the thickness of at least one monolayer does not exceed 25 μm or 29 μm for monolayer strengths of at least 1.2 GPa, 2.5 GPa or 3.0 GPa and preferably for monolayer strengths comprised between 1.2 GPa and 3 GPa, more preferably between 1.5 and 2.6 GPa, and most preferably between 1.8 and 2.4 GPa. A further preferred material sheet according to the invention is characterized in that the thickness of at least one monolayer is comprised between 3 and 29 μm, more preferably between 3 and 25 μm, for monolayer strengths of at least 1.2 GPa, 2.5 GPa or 3.0 GPa and preferably for monolayer strengths comprised between 1.2 GPa and 3 GPa, more preferably between 1.5 and 2.6 GPa, and most preferably between 1.8 and 2.4 GPa. Another preferred material sheet according to the invention is characterized in that the thickness of at least one monolayer is greater than 5 μm, preferably 7 μm, more preferably 10 μm and not exceeding 50 μm for monolayer strengths of at least 1.2 GPa, 2.5 GPa or 3.0 GPa. More preferably the monolayer strengths comprised between 1.2 GPa and 3 GPa, more preferred between 1.5 and 2.6 GPa, and most preferred between 1.8 and 2.4 GPa.

Although it is not necessary according to the invention that all monolayers have the claimed ranges for thickness and strength, a multilayered material sheet wherein all monolayers have the claimed ranges for thickness and strength is particularly preferred.

Unidirectional monolayers may be obtained from oriented tapes or films. With unidirectional tapes and monolayers is meant in the context of this application tapes and monolayers which show a preferred orientation of the polymer chains in one direction, i.e. in the direction of drawing. Such tapes and monolayers may be produced by drawing, preferably by uniaxiaf drawing, and will exhibit anisotropic mechanical properties.

The multilayered material sheet of the invention preferably comprises ultra high molecular weight polyethylene. The ultra high molecular weight polyethylene may be linear or branched, although preferably linear polyethylene is used. Linear polyethylene is herein understood to mean polyethylene with less than 1 side chain per 100 carbon atoms, and preferably with less than 1 side chain per 300 carbon atoms; a side chain or branch generally containing at least 10 carbon atoms. Side chains may suitably be measured by FTIR on a 2 mm thick compression moulded film, as mentioned in e.g. EP 0269151. The linear polyethylene may further contain up to 5 mol % of one or more other alkenes that are copolymerisable therewith, such as propene, butene, pentene, 4-methylpentene, octene. Preferably, the linear polyethylene is of high molar mass with an intrinsic viscosity (IV, as determined on solutions in decalin at 135° C.) of at least 4 dl/g; more preferably of at least 8 dl/g, most preferably of at least 10 dl/g. Such polyethylene is also referred to as ultra high molecular weight polyethylene, UHMWPE. Intrinsic viscosity is a measure for molecular weight that can more easily be determined than actual molar mass parameters like Mn and Mw. A polyethylene film of this type yields particularly good antiballistic properties.

The tapes according to the invention may be prepared in the form of films. A preferred process for the formation of such films or tapes comprises feeding a polymeric powder between a combination of endless belts, compression-moulding the polymeric powder at a temperature below the melting point thereof and rolling the resultant compression-moulded polymer followed by drawing. Such a process is for instance described in EP 0 733 460 A2, which is incorporated herein by reference. If desired, prior to feeding and compression-moulding the polymer powder, the polymer powder may be mixed with a suitable liquid organic compound having a boiling point higher than the melting point of said polymer. Compression moulding may also be carried out by temporarily retaining the polymer powder between the endless belts while conveying them. This may for instance be done by providing pressing platens and/or rollers in connection with the endless belts. Preferably UHMWPE is used in this process. This UHMWPE needs to be drawable in the solid state.

Another preferred process for the formation of films comprises feeding a polymer to an extruder, extruding a film at a temperature above the melting point thereof and drawing the extruded polymer film. If desired, prior to feeding the polymer to the extruder, the polymer may be mixed with a suitable liquid organic compound, for instance to form a gel, such as is preferably the case when using ultra high molecular weight polyethylene.

Preferably the polyethylene films are prepared by such a gel process. A suitable gel spinning process is described in for example GB-A-2042414, GB-A-2051667, EP 0205960 A and WO 01/73173 A1, and in "Advanced Fibre Spinning Technology", Ed. T. Nakajima, Woodhead Publ. Ltd (1994), ISBN 185573 182 7. In short, the gel spinning process comprises preparing a solution of a polyolefin of high intrinsic viscosity, extruding the solution into a film at a temperature above the dissolving temperature, cooling down the film below the gelling temperature, thereby at least partly gelling the film, and drawing the film before, during and/or after at least partial removal of the solvent.

Drawing, preferably uniaxial drawing, of the produced films may be carried out by means known in the art. Such means comprise extrusion stretching and tensile stretching on suitable drawing units. To attain increased mechanical strength and stiffness, drawing may be carried out in multiple steps. In case of the preferred ultra high molecular weight polyethylene films, drawing is typically carded out uniaxially in a number of drawing steps. The first drawing step may for instance comprise drawing to a stretch factor of 3. Multiple drawing may typically result in a stretch factor of 9 for drawing temperatures up to 120° C., a stretch factor of 25 for drawing temperatures up to 140° C., and a stretch factor of 50 for drawing temperatures up to and above 150° C. By multiple drawing at increasing temperatures, stretch factors of about 50 and more may be reached. This results in high strength tapes, whereby for tapes of ultra high molecular weight polyethylene, the claimed strength range of 1.2 GPa to 3 GPa and more may easily be obtained.

The resulting drawn tapes may be used as such to produce a monolayer, or they may be cut to their desired width, or split along the direction of drawing. The width of the thus produced unidirectional tapes is only limited by the width of the film from which they are produced. The width of the tapes preferably is more than 2 mm, more preferably more than 5 mm and most preferably more than 30, 50, 75 or 100 mm. The areal density of the tapes or monolayers can be varied over a large range, for instance between 3 and 200 g/m$^2$. Preferred area density is between 5 and 120 g/m$^2$, more preferred between 10 and 80 g/m$^2$ and most preferred between 15 and 60 g/m$^2$. For UHMWPE, the areal density is preferably less than 50 g/m$^2$ and more preferably fess than 29 g/m$^2$ or 25 g/m$^2$.

A preferred multilayered material sheet according to the invention is characterized in that at least one monolayer comprises a plurality of unidirectional tapes of the drawn polyolefine, aligned in the same direction, whereby adjacent tapes do not overlap. This provides a multilayered material sheet with much simpler construction than the construction disclosed in EP 1627719 A1. Indeed the multilayer material disclosed in EP 1627719 A1 is produced by positioning a plurality of tapes of ultrahigh molecular weight polyethylene adjacent to each other whereby the tapes overlap over some contact area of their longitudinal edges. Preferably this area is additionally covered with polymeric film. The multilayer material of the present preferred embodiment does not require this elaborate construction for good antiballistic performance.

In some embodiments the monolayer may include a binder which is locally applied to bond and stabilise the plurality of unidirectional tapes such that the structure of the mono-layer is retained during handling and making of unidirectional sheets. Suitable binders are described in e.g. EP 0191306 B1, EP 1170925 A1, EP 0683374 B1 and EP 1144740 A1. The application of the binder during the formation of the monolayer advantageously stabilises the tapes, thus enabling faster production cycles to be achieved.

Another particularly preferred multilayer material sheet according to the invention comprises at least one monolayer, preferably all monolayers, built up of a plurality of unidirectional tapes of the drawn polymer, aligned such that they form a woven structure. Such tapes may be manufactured by applying textile techniques, such as weaving, braiding, etc. of small strips of drawn ultra high molecular weight polyolefine and ultra high molecular weight polyethylene in particular. The strips have the same thickness and strength values as required by the invention.

The multilayer material sheet according to the invention preferably comprises at least 2 unidirectional monolayers, preferably at least 4 unidirectional monolayers, more preferably at least 6 unidirectional monolayers, even more preferably at least 8 unidirectional monolayers and most preferably at least 10 unidirectional monolayers. Increasing the number of unidirectional monolayers in the multilayer material sheet of the invention simplifies the manufacture of articles form these material sheets, for instance antiballistic plates.

The invention also relates to a process for the preparation of a multilayered material sheet of the claimed type. The process according to the invention comprises the steps of:

(a) providing a plurality of drawn ultra high molecular weight polyethylene tapes according to the invention, aligned such that each tape is oriented in parallel to adjacent tapes, and whereby adjacent tapes may partially overlap;
(b) positioning said plurality of drawn ultra high molecular weight polyethylene tapes onto a substrate thereby forming a first monolayer;
(c) positioning a plurality of drawn ultra high molecular weight polyethylene tapes according to the invention onto the first monolayer, thus forming a second monolayer, whereby the direction of the second monolayer makes an angle $\alpha$ with respect to the first; and
(d) compressing, under elevated temperature, the thus formed stack to consolidate the monolayers thereof.

By compressing the unidirectional monolayers they are sufficiently interconnected to each other, meaning that the unidirectional monolayers do not delaminate under normal use conditions such as e.g. at room temperature. With the claimed process, a multilayered material sheet having monolayers of the required thickness and strength may readily be produced.

The multilayer material sheet according to the invention is particularly useful in manufacturing ballistic resistant articles, such as vests or armoured plates. Ballistic applications comprise applications with ballistic threat against bullets of several kinds including against armor piercing, so-called AP, bullets improvised explosive devices and hard particles such as e.g. fragments and shrapnel.

The ballistic resistant article according to the invention comprises at least 2 unidirectional monolayers, preferably at least 10 unidirectional monolayers, more preferably at least 20 unidirectional monolayers, even more preferably at least 30 or 40 unidirectional monolayers and most preferably at least 80 unidirectional monolayers. The draw direction of two subsequent monolayers in the stack differs by an angle of α. The angle α is preferably between 45 and 135°, more preferably between 65 and 115° and most preferably between 80 and 100°.

Preferably the ballistic resistant article according to the invention comprises a further sheet of inorganic material selected from the group consisting of ceramic, metal, preferably steel, aluminium, magnesium titanium, nickel, chromium and iron or their alloys, glass and graphite, or combinations thereof. Particularly preferred is metal. In such case the metal in the metal sheet preferably has a melting point of at least 350° C., more preferably at least 500° C., most preferably at least 600° C. Suitable metals include aluminum, magnesium, titanium, copper, nickel, chromium, beryllium, iron and copper including their alloys as e.g steel and stainless steel and alloys of aluminum with magnesium (so-called aluminum 5000 series), and alloys of aluminum with zinc and magnesium or with zinc, magnesium and copper (so-called aluminum 7000 series). In said alloys the amount of e.g. aluminum, magnesium, titanium and iron preferably is at least 50 wt %. Preferred metal sheets comprising aluminum, magnesium, titanium, nickel, chromium, beryllium, iron including their alloys. More preferably the metal sheet is based on aluminum, magnesium, titanium, nickel, chromium, iron and their alloys. This results in a light antiballistic article with a good durability. Even more preferably the iron and its alloys in the metal sheet have a Brinell hardness of at least 500. Most preferably the metal sheet is based on aluminum, magnesium, titanium, and their alloys. This results in the lightest antiballistic article with the highest durability. Durability in this application means the lifetime of a composite under conditions of exposure to heat, moisture, light and UV radiation. Although the further sheet of material may be positioned anywhere in the stack of monolayers, the preferred ballistic resistant article is characterized in that the further sheet of material is positioned at the outside of the stack of monolayers, most preferably at least at the strike face thereof.

The ballistic resistant article according to the invention preferably comprises a further sheet of the above described inorganic material having a thickness of at most 100 mm. Preferably the maximum thickness of the further sheet of inorganic material is 75 mm, more preferably 50 mm, and most preferably 25 mm. This results in the best balance between weight and antiballistic properties. Preferably in the event that the further sheet of inorganic material is a metal sheet, the thickness of the further sheet, preferably a metal sheet, is at least 0.25 mm, more preferably at least 0.5 mm, and most preferably at least 0.75 mm. This results in even better antiballistic performance.

The further sheet of inorganic material may optionally be pre-treated in order to improve adhesion with the multilayer material sheet. Suitable pre-treatment of the further sheet includes mechanical treatment e.g. roughening or cleaning the surface thereof by sanding or grinding, chemical etching with e.g. nitric acid and laminating with polyethylene film.

In another embodiment of the ballistic resistant article a bonding layer, e.g. an adhesive, may be applied between the further sheet and the multilayer material sheet. Such adhesive may comprise an epoxy resin, a polyester resin, a polyurethane resin or a vinylester resin. Preferably, the bonding layer comprises less than 30 wt % of the ballistic resistant article, more preferably less than 20 wt %, even more preferably less than 10 wt % and most preferably less than 5 wt % of the ballistic resistant article.

In another preferred embodiment, the bonding layer may further comprise a woven or non woven layer of inorganic fiber, for instance glass fiber or carbon fiber. It is also possible to attach the further sheet to the multilayer material sheet by mechanical means, such as e.g. screws, bolts and snap fits. In the event that the ballistic resistant article according to the invention is used in ballistic applications where a threat against AP bullets may be encountered the further sheet is preferably comprises a metal sheet covered with a ceramic layer. In this way an antiballistic article is obtained with a layered structure as follows: ceramic layer/metal sheet/at least two unidirectional sheets with the direction of the fibers in the unidirectional sheet at an angle α to the direction of the fibers in an adjacent unidirectional sheet. Suitable ceramic materials include e.g. alumina oxide, titanium oxide, silicium oxide, silicium carbide and boron carbide. The thickness of the ceramic layer depends on the level of ballistic threat but generally varies between 2 mm and 30 mm. This ballistic resistant article is preferably positioned such that the ceramic layer faces the ballistic threat. This gives the best protection against AP bullets and hard fragments.

The invention also relates to a process for the manufacture of a ballistic resistant article comprising the steps of:

(a) stacking at least a multilayered material sheet according to the invention and a further sheet of inorganic material selected from the group consisting of ceramic, steel, aluminum, titanium, glass and graphite, or combinations thereof; and (b) consolidating the stacked sheets under elevated temperature and pressure.

A preferred process for the manufacture of a ballistic resistant article comprises the steps of:

(a) stacking at least a multilayered material sheet comprising a consolidated stack of unidirectional monolayers of drawn ultra high molecular weight polyolefine, whereby the draw direction of two subsequent monolayers in the stack differs, whereby the thickness of at least one monolayer does not exceed 50 μm, more preferably does not exceed 29 μm or even more preferably does not exceed 25 μm, and whereby the strength of at least one monolayer is at least 1.2 GPa, 2.0, 2.5 or 3.0 GPa (or more preferably comprised between 1.2 GPa and 3 GPa), and a further sheet of material selected from the group consisting of ceramic, steel, aluminum, titanium, glass and graphite, or combinations thereof; and (b) consolidating the stacked sheets under elevated temperature and pressure.

Consolidation for all processes described above may suitably be done in a hydraulic press. Consolidation is intended to mean that the monolayers are relatively firmly attached to one another to form one unit. The temperature during consolidating generally is controlled through the temperature of the press. A minimum temperature generally is chosen such that a reasonable speed of consolidation is obtained. In this respect 80° C. is a suitable lower temperature limit, preferably this lower limit is at least 100° C., more preferably at least 120° C., most preferably at least 140° C. A maximum temperature is chosen below the temperature at which the drawn polymer monolayers lose their high mechanical properties due to e.g. melting. Preferably the temperature is at least 10° C., preferably at least 15° C. and even more at least 20° C. below the melting temperature of the drawn polymer monolayer. In case the drawn polymer monolayer does not exhibit a clear melting temperature, the temperature at which the drawn polymer monolayer starts to lose its mechanical properties should be read instead of melting temperature. In the case of the preferred ultra high molecular weight polyethylene, a temperature below 149° C., preferably below 145° C. generally will be chosen. The pressure during consolidating preferably is at least 7 MPa, more preferably at least 15 MPa, even more preferably at least 20 MPa and most preferably at least 35 MPa. In this way a stiff antiballistic article is obtained. The optimum time for consolidation generally ranges from 5 to 120 minutes, depending on conditions such as temperature, pressure and part thickness and can be verified through routine experimentation. In the event that curved antiballistic articles are to be produced it may be advantageous to first pre-shape the further sheet of material into the desired shape, followed by consolidating with the monolayers and/or multilayer material sheet.

Preferably, in order to attain a high ballistic resistance, cooling after compression moulding at high temperature is carried out under pressure as well. Pressure is preferably maintained at least until the temperature is sufficiently low to prevent relaxation. This temperature can be established by one skilled in the art. When a ballistic resistant article comprising monolayers of ultra high molecular weight polyethylene is manufactured, typical compression temperatures range from 90 to 150° C., preferably from 115 to 130° C. Typical compression pressures range between 100 to 400 bar, more preferably 110 to 350 bar and even more preferably 110 to 250 bar, most preferably 120 to 160 bar, whereas compression times are typically between 20, preferably 40 minutes to 180 minutes.

The multilayered material sheet and antiballistic article of the present invention are particularly advantageous over previously known antiballistic materials as they provide an improved level of protection as the known articles at a low weight. Besides ballistic resistance, properties include for instance heat stability, shelf-life, deformation resistance, bonding capacity to other material sheets, formability, and so on.

Test methods as referred to in the present application (unless otherwise indicated), are as follows Intrinsic Viscosity (IV) is determined according to method PTC-179 (Hercules Inc. Rev. Apr. 29, 1982) at 135° C. in decalin, the dissolution time being 16 hours, with DBPC as anti-oxidant in an amount of 2 g/l solution, by extrapolating the viscosity as measured at different concentrations to zero concentration;

Tensile properties (measured at 25° C.): tensile strength (or strength), tensile modulus (or modulus) and elongation at break (or eab) are defined and determined on multifilament yarns as specified in ASTM D885M, using a nominal gauge length of the fiber of 500 mm, a crosshead speed of 50%/min. On the basis of the measured stress-strain curve the modulus is determined as the gradient between 0.3 and 1% strain. For calculation of the modulus and strength, the tensile forces measured are divided by the titre, as determined by weighing 10 metres of fiber; values in GPa are calculated assuming a density of 0.97 g/cm$^3$. Tensile properties of thin films were measured in accordance with ISO 1184(H).

The invention is now further explained by means of the following example and comparative experiment, without being limited hereto.

EXAMPLE AND COMPARATIVE EXPERIMENT

Example

Production of Tape

An ultrahigh molecular weight polyethylene with an intrinsic viscosity of 20 was mixed to become a 7 wt % suspension with decalin. The suspension was fed to an extruder and mixed at a temperature of 170° C. to produce a homogeneous gel. The gel was then fed through a slot die with a width of 600 mm and a thickness of 800 μm. After being extruded through the slot die, the gel was quenched in a water bath, thus creating a gel-tape. The gel tape was stretched toy a factor of 3.8 after which the tape was dried in an oven consisting of two parts at 50° C. and 80° C. until the amount of decalin was below 1%. This dry gel tape was subsequently stretched in an oven at 140° C., with a stretching ratio of 5.8, followed by a second stretching step at an oven temperature of 150° C. to achieve an final thickness of 18 micrometer.

Performance Testing of the Tape

The tensile properties of the tape was tested by twisting the tape at a frequency of 38 twists/meter to form a narrow structure that is tested as for a normal yarn. Further testing was in accordance with ASTM D885M, using a nominal gauge length of the fibre of 500 mm, a crosshead speed of 50%/min and Instron 2714 clamps, of type Fibre Grip D5618C.

Example

Production of Armor Panels from the Tape

A first layer of tapes was placed, with parallel tapes adjacent to each other. A second layer of adjacent parallel tapes was placed on top of the first layer, whereas the directions of the tapes in the second layer were perpendicular to the direction of the tapes of the first layer. Subsequently, a third layer was placed on top of the second layer, again perpendicular to that second layer. The third layer was placed with a small shift (about 5 mm) as compared to the first layer. This shift was applied to minimize a possible accumulation of tape edges at a certain location. A forth layer was placed perpendicular to the third layer, with a small shift as compared to the second layer. The procedure was repeated until an areal density (AD) of 2.57 kg/m$^2$ was reached. The stacks of layered tapes were moved into a press and pressed at a temperature of 145° C. and a pressure of 300 Bar for 65 minutes Cooling was performed under pressure until a temperature of 80° C. was reached. No bonding agent was applied to the tapes. Nevertheless, the stacks had been fused to a rigid homogeneous 800×400 mm plate.

Performance Testing of Armored Panels

The armoured plates were subjected to shooting tests performed with 9 mm parabellum bullets. The tests were performed with the aim of determining a V50 and/or the energy absorbed (E-abs). V50 is the speed at which 50% of the projectiles will penetrate the armoured plate. The testing procedure was as follows. The first projectile was fired at the anticipated V50 speed. The actual speed was measured shortly before impact. If the projectile was stopped, a next projectile was fired at an intended speed of about 10% higher. If it perforated, the next projectile was fires at an intended speed of about 10% lower. The actual speed of impact was always measured. V50 was the average of the two highest stops and the two lowest perforations. The performance of the armour was also determined by calculating the kinetic energy of the projectile at V50 and dividing this by the AD of the plate (E-abs).

Results:

| Example; Compartive Experiment | V50 m/s | E-abs J/(kg/m$^2$) | Thickness μm | Strength GPa |
|---|---|---|---|---|
| 1 | 526 | 388 | 18 | 2.2 |
| A | 423 | 250 | 66 | 3.7 |

Comparative experiment A was performed on sheets formed from commercially available ultrahigh molecular weight polyethylene (UHMWPE) unidirectional fiber. The fibers were impregnated and bonded together with 20 wt % of a thermoplastic polymer. The strength of the monolayers in comparative experiment A was 2.8 GPa, which is the strength of the fibers times the fiber content in the monolayer. The monolayers of the comparative experiment were compressed at about 125° C. under 165 bar pressure for 65 minutes to produce a sheet with the required areal density. The thickness of the monolayers after compressing was 65 micron.

The results confirm that a multilayered material sheet with monolayers not exceeding 50 μm and having a monolayer strength of at least 1.2 GPa produces unexpectedly improved anti-ballistic performance compared to armoured sheets produced from conventional UD fibre based multilayered sheets. In particular, the multilayered material sheet of the present invention produced a significant higher E-abs value than a comparative sample from the prior art.

The invention claimed is:

1. A multilayered material sheet comprising a consolidated stack of unidirectional monolayers of drawn ultra high molecular weight polyolefin, wherein a draw direction of two subsequent monolayers in the stack differs, and wherein a thickness of at least one monolayer does not exceed 50 μm and the strength of at least one monolayer is at least 1.2 Gpa, and wherein the monolayer contains gel-spun polyolefin tapes having a width of at least 2 mm and an areal density of between 3 and 200 g/m$^2$.

2. The material sheet according to claim 1, wherein the strength of at least one monolayer is between 1.2 GPa and 3 GPa.

3. The material sheet according to claim 1, wherein the strength of at least one monolayer is at least 3 GPa.

4. The material sheet according to claim 1, wherein the thickness of the at least one monolayer is greater than 10 μm.

5. The material sheet according to claim 1, wherein the thickness of at least one monolayer does not exceed 29 μm.

6. The material sheet according to claim 3, wherein the thickness of at least one monolayer is between 3 and 29 μm.

7. The material sheet according to claim 1, wherein the strength of at least one monolayer is between 1.5 and 2.6 GPa.

8. The material sheet according to claim 5, wherein the strength of at least one monolayer is between 1.8 and 2.4 GPa.

9. The material sheet according to claim 1, wherein the polyolefin comprises ultra high molecular weight polyethylene.

10. The material sheet according to claim 1, wherein the strength to thickness ratio is at least $4\times10^{13}$N/m$^3$.

11. The material sheet according to claim 1, wherein the draw direction of two subsequent monolayers in the stack differs by an angle a of between 45 and 135°.

12. The material sheet according to claim 1, wherein at least one monolayer comprises a plurality of unidirectional tapes of the drawn polyolefin, the tapes being aligned in the same direction, wherein adjacent tapes of the monolayer do not overlap.

13. The material sheet according to claim 1, wherein at least one monolayer comprises a plurality of unidirectional tapes of the drawn polyolefin, the tapes being aligned such that they form a woven fabric.

14. A ballistic resistant article comprising the material sheet according to claim 1.

15. A ballistic resistant article according to claim 14, comprising at least 10 unidirectional monolayers.

16. A ballistic resistant article according to claim 14, comprising a further sheet of material selected from the group consisting of ceramic, steel, aluminum, magnesium titanium, nickel, chromium and iron or their alloys, glass and graphite, or combinations thereof.

17. A ballistic resistant article according to claim 16, wherein the further sheet of material is positioned at an outside of the stack of monolayers at least at a strike face thereof.

18. A ballistic resistant article according to claim 16, wherein the further sheet of inorganic material has a thickness which is at most 50 mm.

19. A ballistic resistant article according to claim 13, further comprising a bonding layer between the further sheet of material and the material sheet, wherein the bonding layer comprises a woven or non woven layer of inorganic fiber.

20. The material sheet according to claim 1, wherein the draw direction of two subsequent monolayers in the stack differs by an angle a of between 80 and 100°.

21. A polyethylene tape or film obtained by a method comprising:

(a) extruding a solution of polyethylene having an intrinsic viscosity (measured in decalin at 135° C.) between about 4 dl/g and 40 dl/g through an opening having a height of at least 200 micrometer and having a width to height ratio of at least 200 to obtain a fluid product thereof;

(b) stretching the fluid product above a temperature at which a gel will form;

(c) quenching the fluid product in a quench bath consisting of an immiscible liquid to form a gel product;

(d) stretching the gel product;

(e) removing solvent from the gel product and, optionally (f) stretching the gel product, the total stretch ratio being at least 20.

* * * * *